US007614161B2

(12) United States Patent
Haurie et al.

(10) Patent No.: US 7,614,161 B2
(45) Date of Patent: Nov. 10, 2009

(54) CYLINDRICAL DRYER HAVING CONDUITS FOR HEATING MEDIUM

(76) Inventors: Osvaldo Ricardo Haurie, Ciudad de La Paz 2614, 2do B, Capital Federal, Buenos Aires (AR); Richard Kenneth Haurie, 1010 Neal Dr., Alexandria, VA (US) 22308-1931

( * ) Notice: Subject to any disclaimer, the term of this patent is extended or adjusted under 35 U.S.C. 154(b) by 152 days.

(21) Appl. No.: 11/785,614

(22) Filed: Apr. 19, 2007

(65) Prior Publication Data

US 2007/0245588 A1 Oct. 25, 2007

Related U.S. Application Data

(60) Provisional application No. 60/793,657, filed on Apr. 21, 2006.

(51) Int. Cl.
*F26B 11/02* (2006.01)

(52) U.S. Cl. ..... 34/117; 34/124; 34/138; 162/358.9; 165/83

(58) Field of Classification Search ..... 34/413, 34/497, 110, 117, 124, 125; 162/358.9; 165/83
See application file for complete search history.

(56) References Cited

U.S. PATENT DOCUMENTS 1,675,274 A * 6/1928 Miller ..... 165/89
2,193,141 A * 3/1940 Price ..... 237/2 A
2,357,251 A * 8/1944 Behr ..... 122/44.1
2,563,692 A * 8/1951 Ostertag et al. ..... 165/89
2,568,891 A * 9/1951 Walter ..... 261/140.1
2,576,036 A * 11/1951 Ostertag et al. ..... 165/89
2,577,243 A 12/1951 Gunther
2,725,640 A * 12/1955 Voigtman ..... 162/111
2,817,908 A * 12/1957 Lloyd ..... 34/110
2,833,526 A * 5/1958 Otten et al. ..... 165/163
2,844,887 A * 7/1958 Lloyd ..... 34/119
2,893,136 A * 7/1959 Justus et al. ..... 34/119
2,909,849 A 10/1959 Hornbostel
2,915,293 A * 12/1959 Daane et al. ..... 165/88
2,920,874 A * 1/1960 Gardner ..... 165/140
3,022,047 A * 2/1962 Swaney ..... 165/89
3,052,039 A * 9/1962 Johnson ..... 34/110

(Continued)

FOREIGN PATENT DOCUMENTS

EP 1675274 A1 * 6/2006

*Primary Examiner*—Stephen M. Gravini
(74) *Attorney, Agent, or Firm*—Hoffman, Wasson & Gitler

(57) ABSTRACT

A dryer uses conduits to carry a heating medium, such as steam, to heat the outer surface of the dryer. The volume of steam is successfully reduced to non-explosive levels and the shell need not be designed to prevent an explosion. Conduits may be formed through the shell itself or grooves may be formed on the inner surface of the shell, with the conduits retained within the grooves. Also, the conduits can be placed against the inside surface of the dryer and a material, such as zinc, can be filled in about the conduits. The material serves to both retain the conduits in place and thermally couple the conduits to the dryer to assure efficient heat transfer between the conduits and dryer. These modifications relieve the dryer from the Unfired Pressure Vessel classification to the classification of a piping assembly under ASA code regulations. This results in savings in operation safety, installation cost and operating costs due to the absence of costly inspections.

17 Claims, 8 Drawing Sheets

U.S. PATENT DOCUMENTS 3,060,592 A * 10/1962 Ostertag Jr. ..... 34/124
3,061,944 A * 11/1962 Kraus et al. ..... 34/110
3,097,933 A * 7/1963 Kellogg et al. ..... 34/454
3,099,543 A * 7/1963 Malmstrom et al. ..... 34/124
3,116,985 A * 1/1964 Kraus ..... 34/110
3,118,743 A * 1/1964 Malmstrom et al. ..... 34/110
3,169,050 A * 2/1965 Kroon ..... 34/124
3,177,932 A * 4/1965 Smith, Jr. ..... 165/88
3,181,605 A * 5/1965 Smith, Jr. ..... 165/90
RE25,927 E * 12/1965 Justus et al. ..... 165/89
3,224,110 A * 12/1965 Kroon ..... 34/124
3,228,462 A * 1/1966 Smith, Jr. ..... 165/89
3,241,251 A * 3/1966 Justus et al. ..... 34/124
3,258,851 A * 7/1966 Vonderau ..... 34/124
3,264,754 A * 8/1966 Kutchera ..... 34/124
3,299,530 A * 1/1967 Eiss et al. ..... 34/124
3,359,647 A * 12/1967 Webb ..... 34/124
3,367,042 A * 2/1968 Cox, Jr. ..... 34/124
3,447,247 A * 6/1969 Daane ..... 34/122
3,465,727 A * 9/1969 Tidball ..... 122/32
3,473,238 A * 10/1969 Spraker, Jr. et al. ..... 34/125
3,481,050 A * 12/1969 Cox, Jr. ..... 34/124
3,513,565 A * 5/1970 Jacobson ..... 34/125
3,576,078 A * 4/1971 Holt ..... 34/454
3,633,662 A * 1/1972 Voll ..... 165/89
3,640,000 A * 2/1972 Lee et al. ..... 34/125
3,680,627 A * 8/1972 Linning ..... 165/162
3,721,016 A * 3/1973 Lee et al. ..... 34/125
3,724,094 A * 4/1973 Appel et al. ..... 34/124
3,808,700 A * 5/1974 Kraus ..... 34/124
3,812,907 A * 5/1974 Linning ..... 165/83
3,911,595 A * 10/1975 Lande ..... 34/110
3,981,084 A * 9/1976 Sobota ..... 34/123
4,146,361 A * 3/1979 Cirrito ..... 432/60
4,163,688 A * 8/1979 Kankaanpaa ..... 162/359.1
4,185,399 A * 1/1980 Gladish ..... 34/120
4,235,284 A * 11/1980 Coleman ..... 165/141
4,324,613 A * 4/1982 Wahren ..... 162/111
4,384,412 A * 5/1983 Chance et al. ..... 34/119
4,447,964 A * 5/1984 Gardner ..... 34/452
4,688,335 A * 8/1987 Krill et al. ..... 34/273
4,710,272 A * 12/1987 Passarelli et al. ..... 202/205
4,878,299 A * 11/1989 Wedel ..... 34/513
4,955,268 A 9/1990 Ickinger et al.
5,090,135 A * 2/1992 Wolf et al. ..... 34/124
5,335,427 A * 8/1994 Partio ..... 34/119
5,437,107 A * 8/1995 Ensign et al. ..... 34/117
5,445,216 A * 8/1995 Cannata ..... 165/88
5,553,391 A * 9/1996 Bakalar ..... 34/110
5,566,473 A 10/1996 Salminen
5,575,084 A 11/1996 Vuorinen
5,588,223 A * 12/1996 Marshall ..... 34/414
5,966,835 A * 10/1999 Bakalar ..... 34/267
6,079,116 A * 6/2000 Jewitt et al. ..... 34/115
6,161,302 A * 12/2000 Rantala ..... 34/119
6,405,790 B1 * 6/2002 van Haag ..... 165/90
6,560,893 B1 * 5/2003 Bakalar ..... 34/110
6,694,639 B2 * 2/2004 Hanaya ..... 34/115
6,790,315 B2 * 9/2004 Klerelid ..... 162/117
6,877,246 B1 * 4/2005 Hada et al. ..... 34/119
7,143,525 B2 * 12/2006 Hada et al. ..... 34/121
7,540,944 B2 * 6/2009 Bitterly et al. ..... 203/22
2002/0179269 A1 * 12/2002 Klerelid ..... 162/206
2003/0019125 A1 * 1/2003 Hanaya ..... 34/114
2004/0149405 A1 * 8/2004 Beck ..... 162/115
2005/0138832 A1 * 6/2005 Hada et al. ..... 34/122
2006/0179677 A1 * 8/2006 Timm et al. ..... 34/110
2007/0051009 A1 * 3/2007 Hada et al. ..... 34/115
2007/0107884 A1 * 5/2007 Sirkar et al. ..... 165/133
2007/0245588 A1 * 10/2007 Haurie et al. ..... 34/114
2007/0289156 A1 * 12/2007 Kloibhofer et al. ..... 34/119
2008/0005921 A1 * 1/2008 Gruber-Nadlinger et al. .. 34/108

* cited by examiner

CYLINDRICAL DRYER HAVING CONDUITS FOR HEATING MEDIUM

This application claims benefit of provisional application 60/793,657, filed Apr. 21, 2006.

BACKGROUND OF THE INVENTION

Cylindrical dryers are used in the paper making process. Webs of paper are passed over heated cylindrical drums to remove moisture from the web. The large cylindrical dryers, often referred to as "Yankee Dryers," must be continuously heated to maintain an elevated temperature during the paper making process.

One type of Yankee dryer has an inner and outer shell. The space created between the inner and outer shell is fed with a heating medium, such as steam under pressure, to heat the outer surface of the dryer. The dryers are commonly made out of cast iron. A double shelled cast iron dryer is difficult to cast, costly and extremely heavy. Double shelled dryers were very rare and the idea was abandoned early.

Another type of Yankee dryer has a closed cylinder with pressurized steam fed into the cylinder. The pressurized steam raises the possibility of catastrophic explosion when the cylinder fails under the pressure. One possible solution to explosion risks in a pressurized cylinder type Yankee dryer is to fill the volume within the cylinder with spheres. Spheres occupy space within the cylinder and reduces the amount of pressurized steam. This reduced amount of pressurized steam lowers the risk of explosions. Problems with this approach include the need to use a non-compressible material for the spheres, increasing the weight of the dryer. Also, with spheres of equal size the total volume cannot be reduced more than approximately two thirds. This reduction is not enough for the purposes of reducing the amount of steam.

SUMMARY OF THE INVENTION

A dryer uses conduits to carry a heating medium, such as steam, to heat the outer surface of the dryer. The volume of steam is successfully reduced to non-explosive levels and the shell need not be designed to prevent an explosion. Conduits may be formed through the shell itself or grooves may be formed on the inner surface of the shell, with the conduits retained within the grooves. Also, the conduits can be placed against the inside surface of the dryer and a material, such as zinc, can be filled in about the conduits. The material serves to both retain the conduits in place and thermally couple the conduits to the dryer to assure efficient heat transfer between the conduits and dryer. These modifications relieve the dryer from the Unfired Pressure Vessel classification to the classification of a piping assembly under ASA code regulations. This results in savings in operation safety, installation cost and operating costs due to the absence of costly inspections.

DETAILED DESCRIPTION OF THE INVENTION

Figure 1:
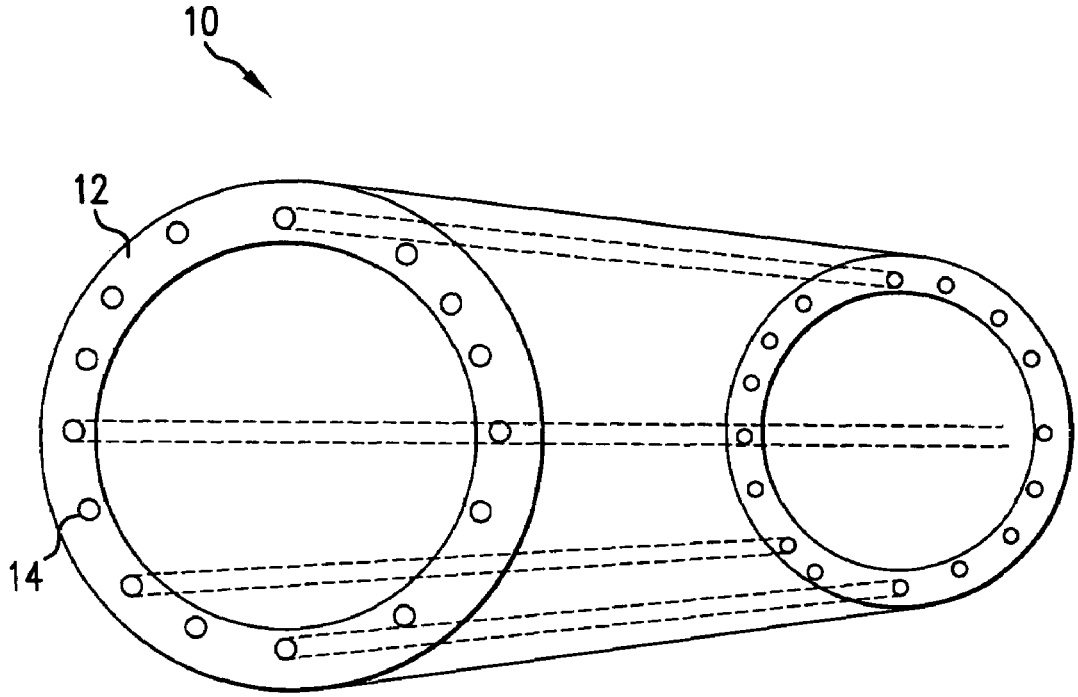
FIG. 1 shows a perspective view of shells having conduits formed within the shell.

FIG. 1 shows a dryer 10 formed by a single shell 12 with a series of conduits 14 running along the length of the dryer. The dryer 10 is made of any suitable material, such as cast iron or stainless steel. These conduits 14 continuously carry a heating medium, such as steam, to heat the outside surface of the dryer, over which the paper web passes. By forming conduits within the shell, heat transfer occurs about the entire perimeter of the conduit, affording a maximum heat transfer surface. By way of example, a shell having a ¾ inch thickness can have conduits ¼ inch in diameter. The number of conduits is limited to maintain the shell's integrity.

Figure 2:
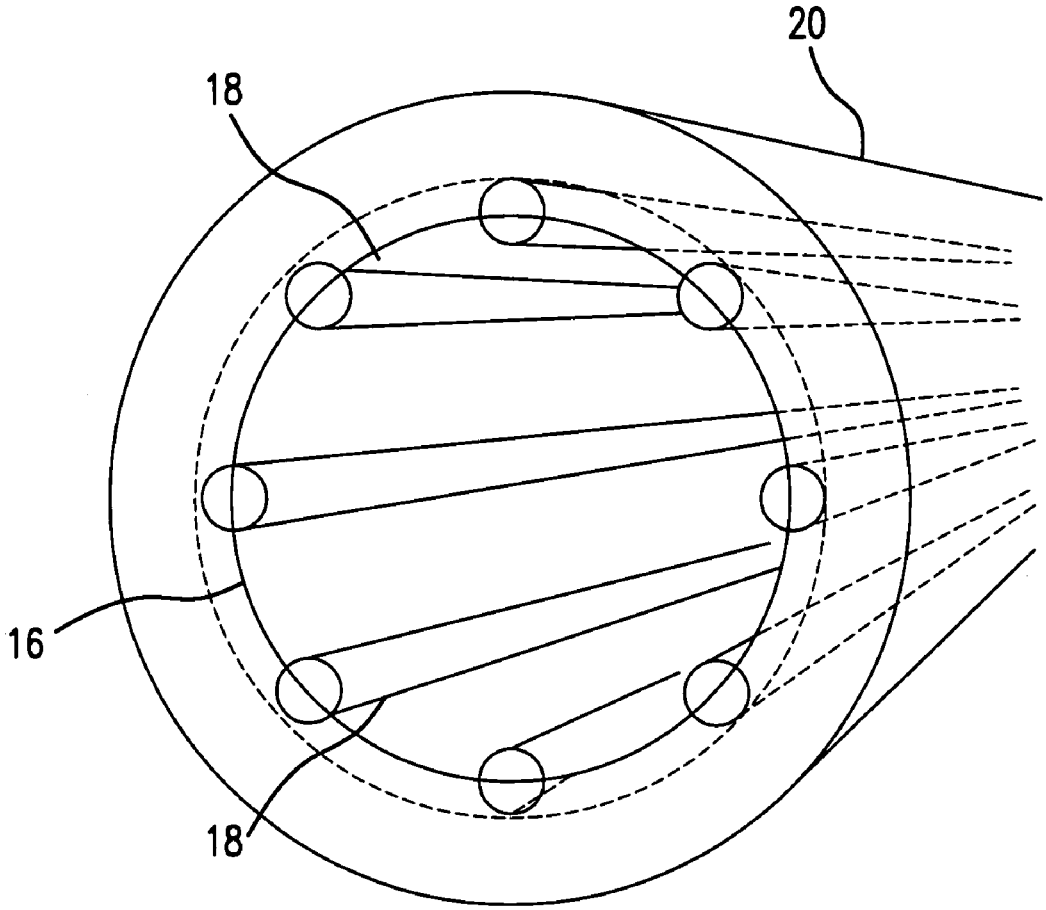
FIG. 2 shows an end perspective view of a shell having conduits on the inner surface.

An alternative arrangement shown in FIG. 2 forms grooves within the inner surface 16 of the shell and places conduits 18 within the groove. The grooves can have a depth equal to half the diameter of the conduits. A conduit inserted to a depth equal to its radius and placed side-to-side offers an increase of 54% in heat transfer surface of the inside surface 16 of the dryer. Conduits are often spaced from one another, not place side-to-side, reducing the 54% increase in surface area of the inner surface but enough conduits are used to effectively heat the outside surface 20 of the dryer.

Figure 3:
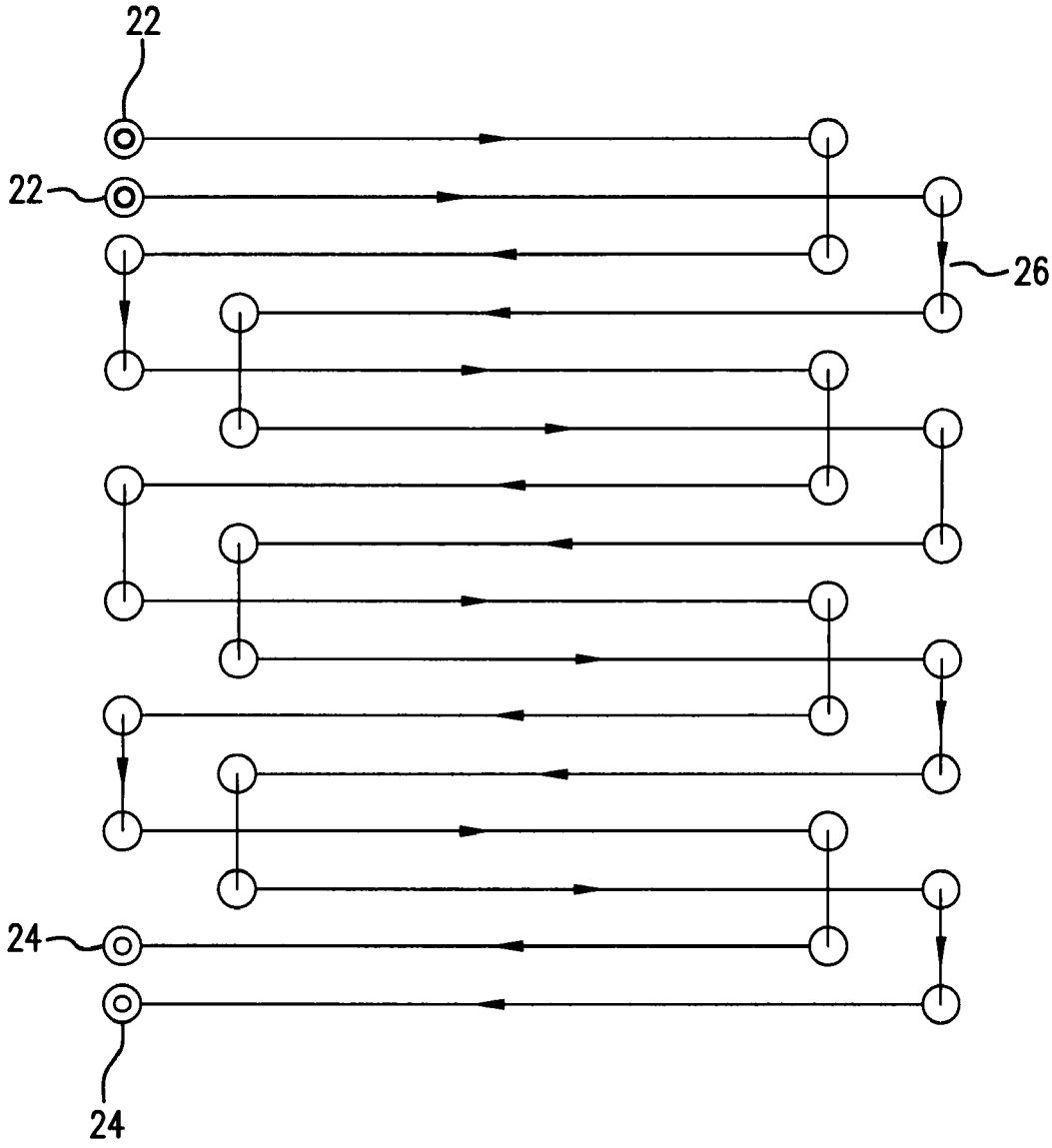
FIG. 3 shows a flow path for the conduits.

FIG. 3 shows a schematic diagram of the heating medium flow through the conduits. In this view, the left and right side of the dryer are represented on the left and right sides of the diagram. The layout is as if the dryer has been split along its length and been flattened, so that the inner surface of the dryer is visible. In this arrangement, two inlets 22 and two outlets 24 are used to establish two parallel flows of heating medium. The heating medium enters through the inlet, travels the entire length of the dryer through the conduit and then connects to another conduit through a riser 26 and flows back to the left side. This process is repeated as the heating medium moves back and forth across the length of the dryer until it reaches the outlet 24. While two parallel flows are shown, it is understood that any number of inlets and outlets may be used and the outlets may be on the end opposite of the inlet.

Figure 4A:
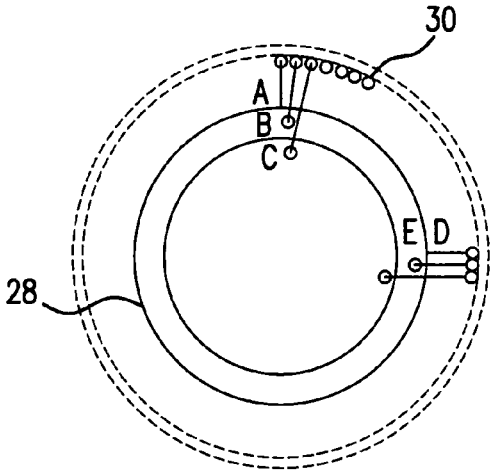
FIGS. 4*a* and 4*b* shows end and side views of an alternative arrangement for providing steam to conduits.
Figure 4B:
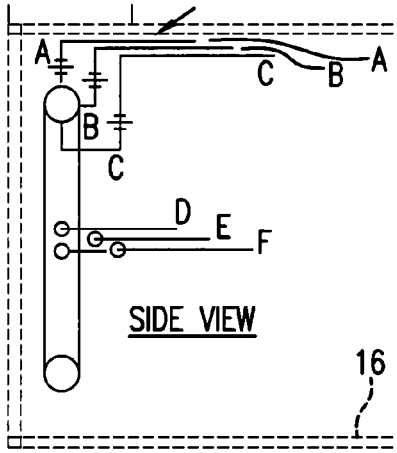

FIG. 4*a* shows an alternative arrangement, providing each conduit with an inlet and outlet for steam. This arrangement can be used when using iron pipes and offers easier assembly and maintenance. A circular header 28 providing steam has a series of conduits 30 attached thereto. As seen in FIG. 4*b*, the conduits 30 are attached to the top, side and bottom surfaces of the circular header 28 allowing a greater number of ports without sacrificing the structural integrity of the header. Each conduit 30 receives heating medium from the header and connects to a similar header at the opposite end of the dryer as an outlet.

Figure 5:
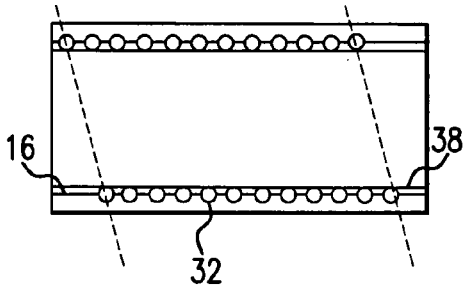
FIG. 5 shows a side cross-sectional view of coiled conduits on the inner surface of a shell.

FIG. 5 shows a view of a dryer having a helically arranged tube 32 extending the length of the dryer. Again, the tube may be inserted in grooves having a depth equal to the radius of the tube. One advantage of the helical arranged coils is that, upon heating, the helix expands, further securing the tubes within the groove. Conduits placed against the inner surface 16 the dryer may be embedded in a filler material such as zinc to create a new inner surface 38. The conduits can be completely embedded but this is not necessary. The material thermally and mechanically couples the conduit to the dryer. This process requires no machining of the dryer and ensures a high rate of thermal transfer from the steam to the outside surface 40 of the dryer. This process can be retrofitted to existing dryers, regardless of the shell thickness and used with axially extending tubes, as well as a helically extending tube.

Figure 6:
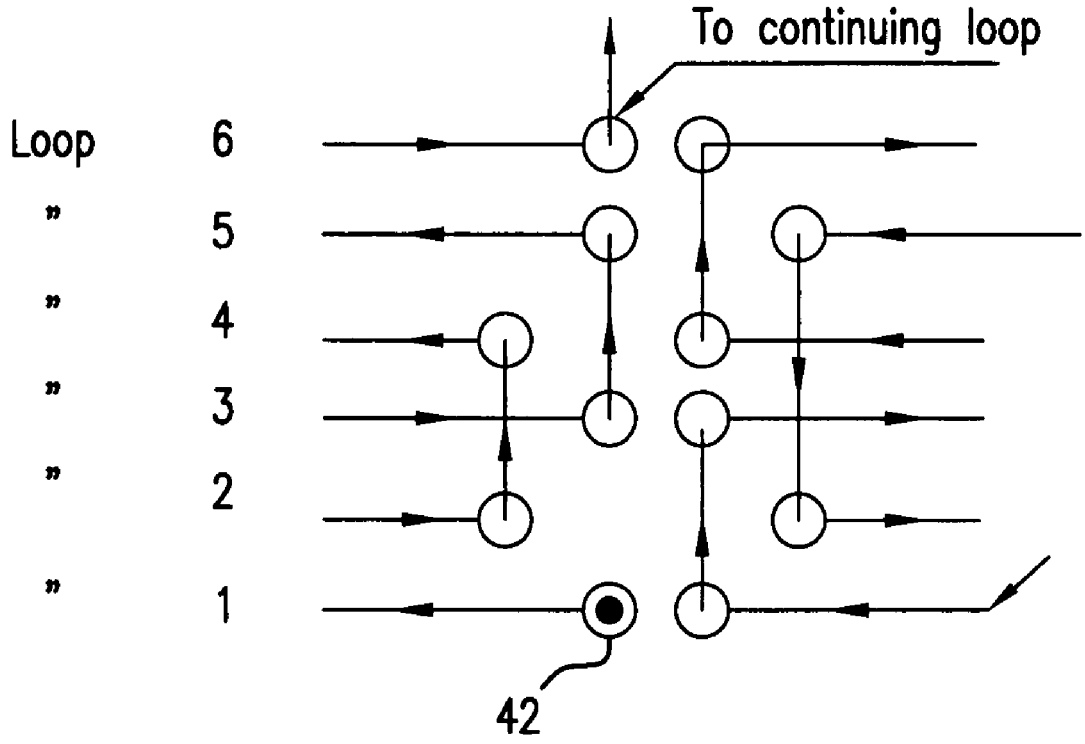
FIG. 6 shows a flow diagram for steam through the loop arrangement.

FIG. 6 shows the movement of steam, or other heating medium, through loops. Starting with the steam supply 42, the steam extends through the first loop, connects to the third loop. After completion of the three loops, steam is transferred to the fifth loop. As seen in the drawings, when complete with the fifth loop, steam is returned to the second loop through a conduit. Upon completion of the second loop, steam travels to the fourth loop and, finally, to the sixth loop.

Figure 7:
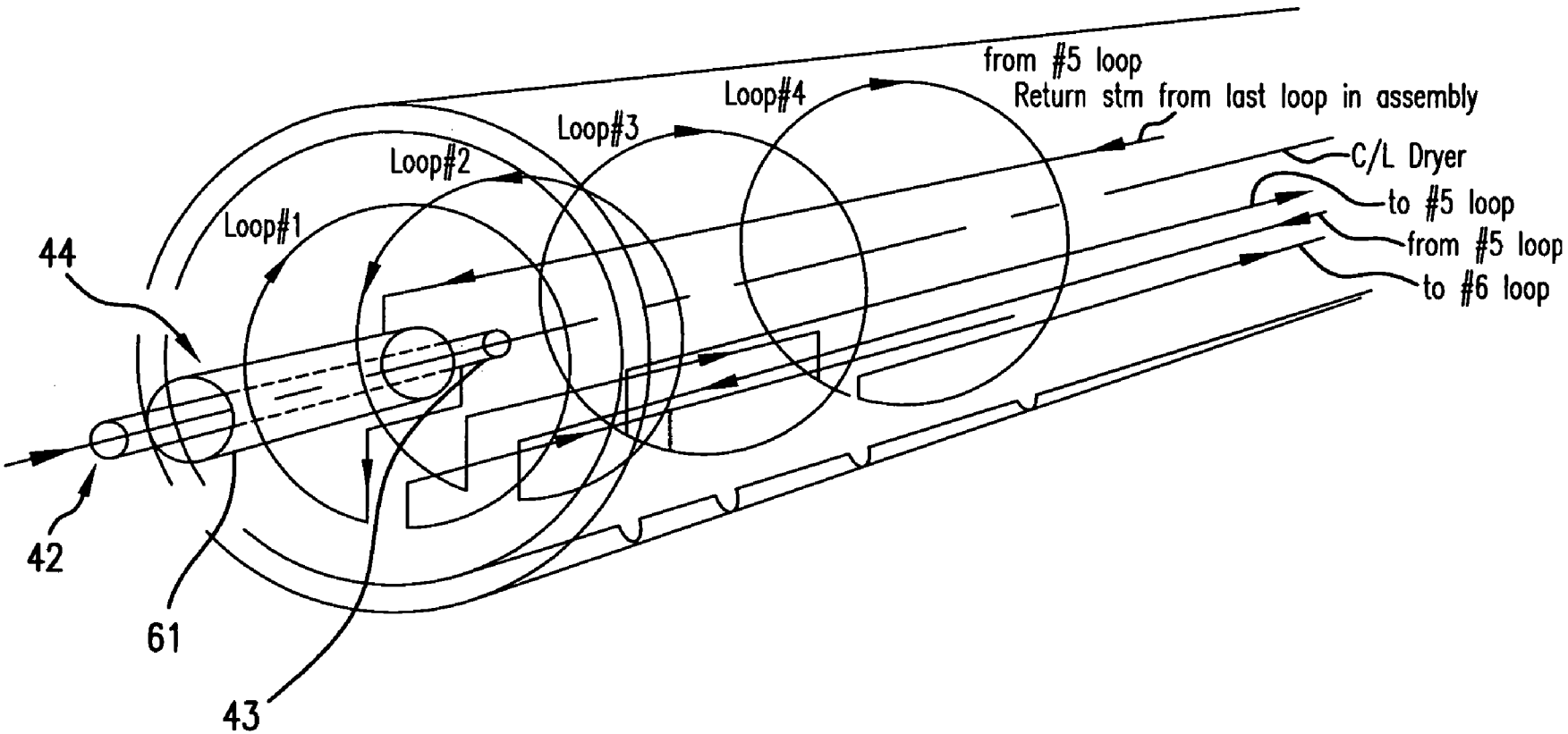
FIG. 7 is a perspective view of the flow path of steam through loops.

FIG. 7 shows this path in a three-dimensional perspective view with loops one through four shown for purposes of clarity. Also seen in FIG. 7 is the concentric steam supply 42 and outlet 44. The inner tube 43, having a length greater than the outer tube 61, carries the inlet steam with the outer, larger and shorter tube, serving as the outlet for exhaust steam.

Figure 8:
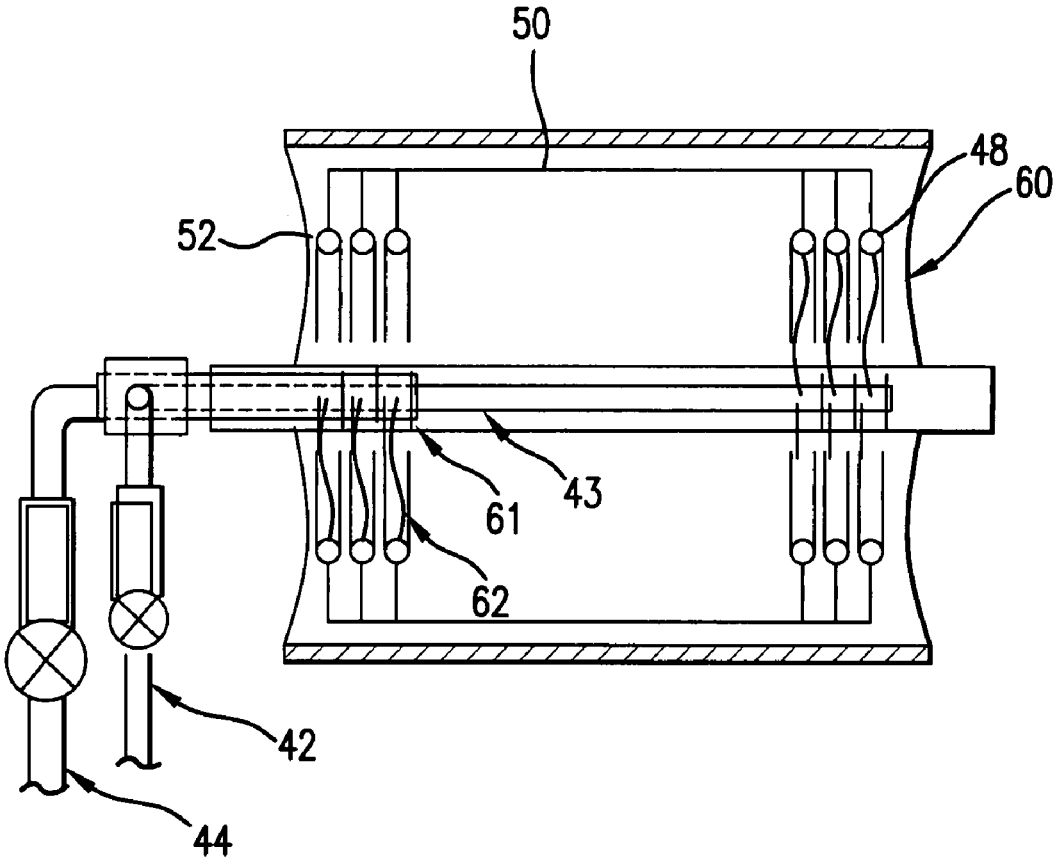
FIG. 8 is a side cross-sectional view of an alternative arrangement for providing steam through a heat transfer tube.
Figure 9:
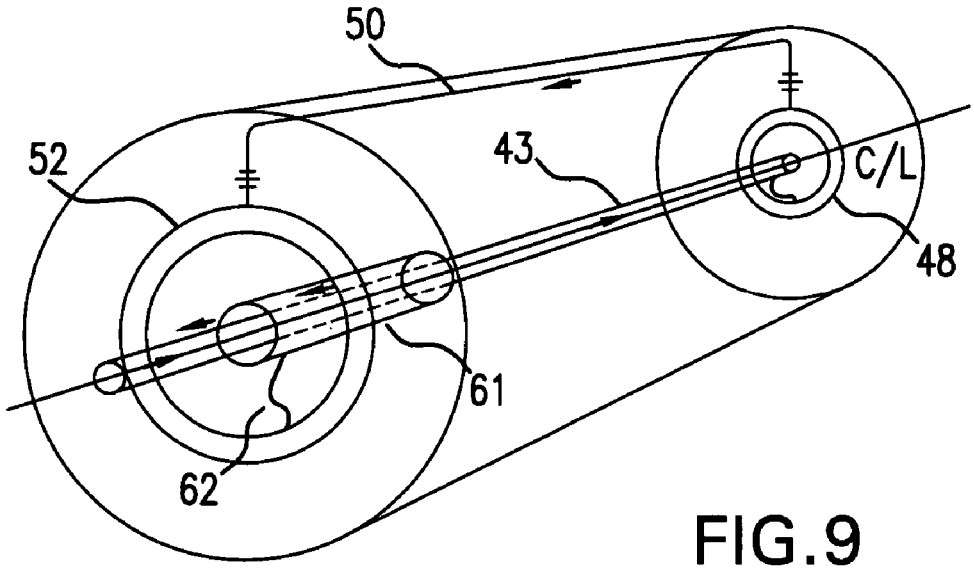
FIG. 9 is a perspective view of the arrangement of FIG. 9.

FIG. 8 shows an arrangement using the concentric steam supply and return. In this arrangement, the steam supply stem 43 extends the entire length of the dryer and feeds a series of floating ring headers 48 by steam hoses 60. Heat transfer tubes 50 receive the steam from the headers and are connected to exhaust return steam ring headers 52 which, in turn, connect to the outer steam return 61 by steam hoses 62. The arrangement is also clearly seen in FIG. 9, which uses a single steam supply 46 and exhaust return steam ring headers 52.

Figure 10:
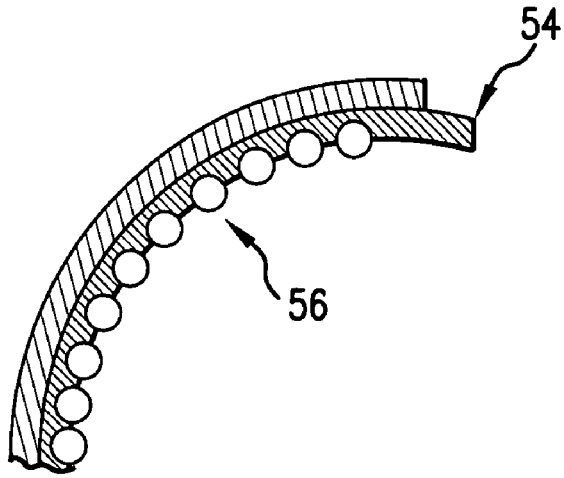
FIG. 10 is a cross sectional view of a shell having a holding plate.

FIG. 10 is a cross section view of a shell using a holding plate 54 to which conduits 56 are attached. To facilitate assembly of new dryers or the retrofitting of existing dryers, the conduits are first attached to the holding plate 54 and then the holding plate to attached to the inner surface of the dryer. An advantage of this arrangement is the ability to use several holding plates to cover the interior surface of the dryer.

The use of conduits on the inner surface of a dryer shell allows higher pressure steam to be used. Existing dryers can be retrofit with grooves and conduits at little cost. The system has a longer life span and less down time than prior yankee dryers leading to great savings for the manufacturing plants.

While the invention has been described with reference to preferred embodiments, variations and modifications would be apparent to one of ordinary skill in the art. The invention encompasses such variations and modifications.

What is claimed is:

1. A Yankee dryer, comprising:

an open ended cylindrical shell having an outer surface and an inner surface, said cylindrical shell provided with a first open end portion and a second open end portion, a plurality of fluid conduits in said dryer, said fluid conduits contacting said inner surface of said open ended cylindrical shell thereby heating said inner surface and said outer surface of cylindrical shell by conduction and a source of heating medium connected to said plurality of conduits;

wherein since said cylindrical shell is not sealed at both ends and no heating medium is provided outside of said conduits within said shell, no condensate is produced within said cylindrical shell outside of said plurality of conduits, and no buildup of pressure can occur within said shell outside of said plurality of conduits, and wherein existing dryers can be retrofitted with said plurality of conduits and removing the covers at the ends of the dryer, to produce a longer life span and little down time and further wherein, the Yankee dryer thus produced or retrofitted is an unpressurized vessel.

2. The dryer of claim 1, further comprising a first header surrounded by said first end portion of said shell and a second header surrounded by said second portion of said shell and said plurality of conduits extending between said first header and said second header, said first header connected to said source of heating medium and said second header connected to an exhaust.

3. The dryer of claim 1, wherein a plurality of helically extending conduits is provided, said helically extending conduits contacting the inner surface of the shell.

4. The dryer of claim 1, wherein said plurality of conduits rest tightly within plurality of grooves provided on said shell inner surface.

5. The dryer of claim 3, further comprising:

a filler material about said helically extending conduits.

6. The dryer of claim 1, further comprising:

a plurality of grooved, holding plates, said plurality of grooved holding plates attached to the inner surface of said shell for providing a solid medium through which said shell is heated by conduction.

7. The dryer of claim 1, wherein the heating medium is steam.

8. The dryer of claim 2, further comprising:

at least one inlet, at least one outlet, a plurality of conduits extending along and contacting the inner surface of said shell, each said conduit extending between first and second headers.

9. The dryer in accordance with claim 2, wherein said inner surface of said shell is provided with a plurality of grooves into which each of said conduits is placed.

10. The dryer of claim 3, wherein said helically extending conduits rest tightly within a plurality of grooves provided on said shell inner surface.

11. The dryer in accordance with claim 7, wherein the diameter of said shell is not constrained to a particular diameter due to the lack of internal pressure, within said shell outside of said plurality of conduits.

12. The dryer of claim 1 further providing a plurality of grooves in said inner surface in which said plurality of conduits are tightly fitted, wherein the ability to transfer heat to said cylindrical shell is increased by intensity, said plurality of conduits to half their diameter, thus augmenting the total heat transfer due to the increased contact area.

13. The dryer of claim 1, further comprising:

a plurality of grooved, holding plates, said plurality of grooved holding plates attached to the inner surface of said shell for providing a solid medium of varying materials through which said shell is heated evenly.

14. The dryer of claim 1, further comprising:

a plurality of grooved, holding plates, said plurality of grooved holding plates attached to the inner surface of said shell for providing a solid medium of varying contact surface features through which said shell is heated evenly.

15. The dryer of claim 1, further comprising:

a plurality of grooved, holding plates, said plurality of grooved holding plates attached to the inner surface of said shell and making said shell expendable and/or replaceable.

16. The dryer of claim 1, further comprising:

a plurality of grooved, holding plates, said plurality of grooved holding plates attached to the inner surface of said shell are recyclable and reusable within other similar shells as prior shells to which they were attached deteriorate beyond effective use.

17. The dryer of claim 1, further comprising:

a plurality of grooved, holding plates, said plurality of grooved holding plates attached to the inner surface of said shell are recyclable and reusable within other similar shells that have not been specially or specifically designed or constructed to contain them.

* * * * *